US005661346A

United States Patent [19]

Budzyn et al.

[11] Patent Number: 5,661,346

[45] Date of Patent: Aug. 26, 1997

[54] CUSTOMER SELECTABLE FEED FOR CIGAR LIGHTER/POWER OUTLET

[75] Inventors: James W. Budzyn, Troy; Peter J. Byk, Sterling Heights, both of Mich.

[73] Assignee: Chrysler Corporation, Auburn Hills, Mich.

[21] Appl. No.: 420,530

[22] Filed: Apr. 12, 1995

[51] Int. Cl.[6] ..... H01R 29/00

[52] U.S. Cl. ..... 307/10.1; 307/9.1; 439/685; 439/218; 439/78

[58] Field of Search ..... 307/9.1, 10.1, 307/10.2–10.8; 439/685, 217, 218, 221, 78, 620

[56] References Cited

U.S. PATENT DOCUMENTS

| | | | |
|---|---|---|---|
| 2,755,350 | 7/1956 | Fahlberg | 200/51.05 |
| 3,231,767 | 1/1966 | Powell | 439/221 |
| 4,000,409 | 12/1976 | Graziosi | 307/115 |
| 4,642,477 | 2/1987 | Grzanowski, Jr. et al. | 307/113 |
| 4,905,115 | 2/1990 | Whidden et al. | 361/92 |
| 4,926,110 | 5/1990 | Yoon | 323/345 |
| 4,965,461 | 10/1990 | McRoberts, Jr. | 307/10.8 |
| 5,149,985 | 9/1992 | Fujiwara | 307/10.7 |
| 5,381,050 | 1/1995 | Siclari et al. | 439/221 |

*Primary Examiner*—William M. Shoop, Jr.
*Assistant Examiner*—Peter Ganjian
*Attorney, Agent, or Firm*—Margaret A. Dobrowitsky

[57] ABSTRACT

A circuit arrangement for an automotive electrical power system to connect an electrical load to the vehicle battery power system either directly so that the load is powered continuously or through an ignition switch so that the load is powered only when the ignition switch is turned on. A plurality of female spade-type contact receptacles includes a first receptacle for connection directly to the vehicle battery power system, a second receptacle for connection to the ignition switch and a third receptacle for connection to the load. The contact receptacles are disposed relative to each other for receiving an automotive-type fuse assembly, having parallel coplanar male spade-type contact plugs, alternately in a first position between the first and third contact receptacles and a second position between the second and third contact receptacles.

11 Claims, 1 Drawing Sheet

CUSTOMER SELECTABLE FEED FOR CIGAR LIGHTER/POWER OUTLET

The present invention is directed to a circuit arrangement for connecting an electrical load alternately to first and second connection points at which electrical power, is available and more power system for connecting the electrical load to the vehicle battery power system either directly or through the vehicle ignition switch.

BACKGROUND AND SUMMARY OF THE INVENTION

In electrical power systems, such as automotive power systems, it is often desirable to provide a user with facility for connecting a load alternately to first and second connection points at which electrical power is available, either from the same or separate power sources. For example, in an automotive electrical power system, a user may desire to connect an electrical load, such as the cigar/cigarette lighter socket, to the vehicle battery power system directly rather than through the ignition switch. In this way, in this specific example, the cigar/cigarette outlet socket of the vehicle may be employed for supplying electrical power to accessories, such as audio accessories or an emergency lamp, independent of the vehicle ignition switch.

A general object of the present invention is to provide a circuit arrangement by means of which a user may selectively and alternately connect an electrical load to either of two electrical power connection points. A further object of the present invention is to provide a circuit arrangement of the described character that is constructed in such a way as to ensure that the load cannot be connected to both power connection points simultaneously. Another and more specific object of the present invention is to provide a circuit arrangement of the described character that is economical to manufacture, that employs standard electrical components, and that may be readily and easily employed in the field by an untrained user for connecting the electrical load back and forth between the two power sources. As applied specifically to an automotive electrical power system, it is a further object of the present invention to provide a circuit arrangement of the described character for connecting a vehicle electrical load to the vehicle battery power system either directly so that the load is powered continuously, or through an ignition switch so that the load is powered only when the ignition switch is turned on.

A circuit arrangement for connecting an electrical load alternately to first and second points at which electrical power is available in accordance with the present invention includes a plurality of electrical contacts with a first contact being for connection to the first power connection point, a second contact being for connection to the second power connection point and a third contact for connection to the load. A fused connector is connectable to the contacts in a first position between the first and third contacts to connect the load to the first power connection point, and alternatively in a second position between the second and third contacts to connect the load to the second power connection point. The pluralities of electrical contacts in the preferred embodiments of the invention are arranged such that fused connectors cannot be connected in both of the first and second positions simultaneously, so that the load cannot be connected to both power connection point simultaneously.

In the preferred embodiments of the invention, the fused connector takes the form of an automotive-type fuse assembly having parallel coplanar male spade-type contact plugs.

The plurality of contacts comprise female spade-type contact receptacles disposed relative to each other for removable reception of the male spade-type contact plugs of the fused connector in either of the first and second positions.

As applied specifically to an automotive electrical power system, a circuit arrangement in accordance with the present invention includes a plurality of at least three female spade-type contact receptacles, of which a first is for connection directly to the vehicle battery power system, a second is for connection to the vehicle ignition switch and the third is for connection to the load. The spade-type contact receptacles are disposed relative to each other for receiving an automotive-type fuse assembly having parallel coplanar male spade-type contact plugs alternately in a first position between the first and third contact receptacles and a second position between the second and third contact receptacles. In a first embodiment of the invention, the contact receptacles comprise three contact receptacles disposed in lateral alignment with each other, with the outer receptacles being connected to the vehicle/battery power system and the ignition switch, and the middle contact being connected to the load. In a second embodiment of the invention, the plurality of contact receptacles comprise four contact receptacles disposed in aligned coplanar pairs at right angles to each other. One contact receptacle of each pair is connected to the load and the other contact receptacle of each pair is connected to the vehicle battery power system either directly or through the ignition switch.

BRIEF DESCRIPTION OF THE DRAWING

The invention, together with additional objects,, features and advantages thereof, will be best understood from the following description, the appended claims and the accompanying drawing in which:

DETAILED DESCRIPTION OF PREFERRED EMBODIMENTS

Figure 1:
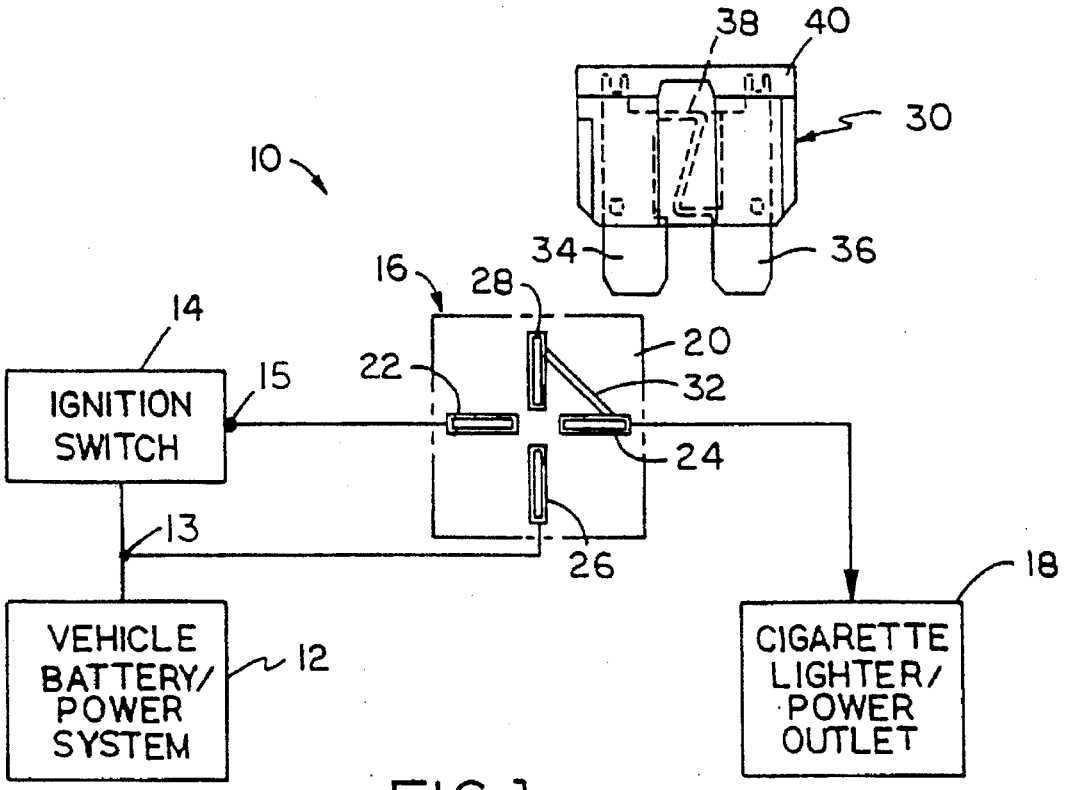
FIG. 1 is a schematic diagram of a circuit arrangement in accordance with one presently preferred embodiment of the invention.

FIG. 1 illustrates a portion 10 of an automotive electrical power system that includes a vehicle battery/power system 12 with a vehicle battery and alternator, etc. An ignition switch 14 having an output connection point 15 is provided for selectively applying electrical power from vehicle battery/power system output connection point 15 to the automotive ignition system and other vehicle components and loads. Ignition switch 14 would typically include a key switch operable by the vehicle driver, and one or more relay or solid state switches responsive to the key switch. In accordance with the present invention, a circuit arrangement 16 is provided for connecting a power load, such as a cigarette lighter/power outlet 18, to vehicle battery/power system 12, either directly or through ignition switch 14.

Circuit arrangement 16 in the embodiment of FIG. 1 comprises a connector block 20 having four rectangular female spade-type contact receptacles 22,24,26,28 mounted thereon. Contact receptacles 22–28 are mounted within connector block 30 in orthogonally disposed pairs 22,24 and 26,28, with the receptacles of each pair being coplanar with each other and spaced from each other for removable reception of a standard automotive-type fuse assembly 30 of suitable size and configuration. Receptacle 26 is connected directly to vehicle battery/power system 12, and receptacle 22 is connected to output connection point 13 of system 12 through ignition switch 14 output connection point 15. Contact receptacles 28,24 are interconnected by a connection bus 32, and are connected to load 18.

Fuse 30 is of standard configuration, having a pair of male spade-type contact plugs 34,36 parallel and coplanar with each other, and at specified fixed spacing from each other. A fuse link 38 interconnects contact plugs 34,36 within an encapsulated body 40, the color of which conventionally indicates fuse rating. Female contact receptacle pairs 22,24 and 26,28 are spaced from each other within contact block 20 in coordination with spacing between contact plugs 34,36 of fuse 30 so that fuse 30 may be selectively and removably assembled to contact block 20, either in a first position bridging contact receptacles 22,24 and connecting load 18 to ignition switch 14, or in a second position bridging contact receptacles 26,28 and connecting load 18 directly to vehicle battery/power system 12. Contact block 20 preferably is mounted on the vehicle fuse panel, with the rating of fuse 30 being suitable for the specific load 18 in question, in this case the cigarette/power outlet in the example of FIG. 1. Thus, the vehicle owner/user can readily alternate connection of load 18 either to system 12 directly or through ignition switch 14 by simply removing, reorienting and reinserting fuse 30 as desired.

Figure 2:
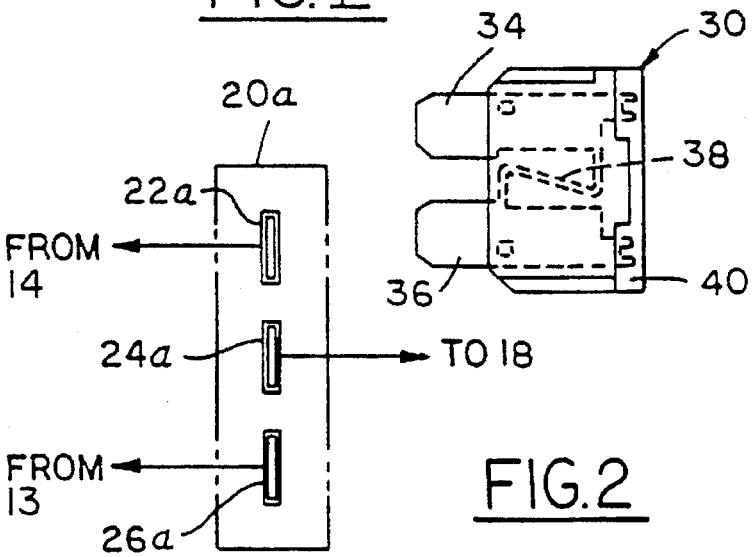
FIG. 2 is a schematic diagram of a modification to the circuit arrangement of FIG. 1.

FIG. 2 illustrates a modification 16*a* to the system of FIG. 1, in which contact block 20*a* has three female spade-type contact receptacles 22*a*,24*a*,26*a*, rather than four contact receptacles as in the embodiment of FIG. 1. Contact receptacles 22*a*,24*a*,26*a* in the embodiment of FIG. 2 are disposed in aligned coplanar relationship, with the spacing between adjacent pairs of contact receptacles 22*a*,24*a* and 24*a*,26*a* corresponding to spacing between parallel coplanar male spade-type contact plugs 34,36 in fuse 30. Contact receptacle 22*a* is connected to ignition switch output connection point 15 (FIG. 1), and contact receptacle 26*a* is connected directly to vehicle battery/power system output connection point 13. Contact 24*a* is connected to load 18, the cigarette lighter/power outlet in the example of FIG. 1. Thus, fuse 30 may be selectively and removably connected either between contact pair 24*a*,26*a* for connecting load 18 directly to vehicle battery/power system 12, or between contact pair 22*a*,24*a* for connecting load 18 to power system 12 through ignition switch 14. Again, contact block 20*a* preferably is mounted on the vehicle fuse panel for easy access by the vehicle user.

We claim:

1. A circuit arrangement for connecting an electrical load alternately to first and second connection points at which electrical power is available, said circuit arrangement comprising:

a plurality of contact means including first contact means for connection to the first power connection point, second contact means separate from said first contact means for connection to the second power connection point, and third contact means separate from said first and second contact means for connection to the load, and unitary connection means including a fuse for connection to said contact means in a first position between said first and third contact means to connect the load to the first power connection point, and alternately in a second position between said second and third contact means to connect the load to the second power connection point.

2. The circuit arrangement set forth in claim 1 wherein said connection means comprises fourth and fifth contact means at predetermined fixed spacing relative to each other, and wherein said plurality of contact means are at predetermined fixed spacing from each other in coordination with spacing between said fourth and fifth contact means with each other such that said connection means is connectable to said plurality of contact means alternately in said first and second positions.

3. The circuit arrangement set forth in claim 2 wherein said connection means is adapted for selective removable connection to said plurality of contact means alternately in said first and second positions.

4. The circuit arrangement set forth in claim 2 wherein said connection means comprises an automotive-type fuse assembly in which said fourth and fifth contact means comprise parallel coplanar male spade-type contact means, and wherein said plurality of contact means comprises female spade-type contact means disposed relative to each other for removable reception of said male spade-type contact means of said connection means in either of said first and second positions.

5. The circuit arrangement set forth in claim 2 wherein said plurality of contact means comprises three contact means disposed in lateral alignment with each other, outer ones of said three contact means being connected respectively to the first and second power sources and the inner one of said contact means being connected to the load, said connection means being connectable between said inner contact means and one or the other of said outer contact means in said first and second positions respectively.

6. The circuit arrangement set forth in claim 2 wherein said plurality of contact means comprises four contact means disposed in aligned pairs angularly spaced from each other, one contact means of each said pair being connected to the load and the other contact means of each said pair being for connection to the first and second power connection points respectively, said connection means being connectable between contacts of each said pair alternately in said first and second positions.

7. The circuit arrangement set forth in claim 6 wherein said pairs are disposed at right angle to each other.

8. A circuit arrangement in an automotive electrical power system for connecting an electrical load to a vehicle battery power system either directly so that the load is powered continuously or through an ignition switch so that the load is powered when the ignition switch is turned on, said circuit arrangement comprising:

a plurality of at least three female spade-type contact means, of which a first is for connection directly to the vehicle battery power system, a second is for connection to the ignition switch and a third is for connection to the load, said contact means being disposed relative to each other for receiving an automotive-type fuse assembly having parallel coplanar male spade-type contact means alternately in a first position between said first and third contact means and a second position between said second and third contact means.

9. The circuit arrangement set forth in claim 8 wherein said plurality of female spade-type contact means comprises three female spade-type contact means disposed in lateral alignment with each other, outer ones of said three contact means being for connection respectively to the vehicle battery power system and the load, and the inner one of said female spade-type contact means being for connection to the load.

10. The circuit arrangement set forth in claim 8 wherein said plurality of female spade-type contact means comprises four female spade-type contact means disposed in aligned pairs angularly spaced from each other, one contact means of each said pair being for connection to the load and the other contact means of each said pair being for connection to the vehicle battery power system and the ignition switch respectively.

11. The circuit arrangement set forth in claim 10 wherein said pairs are disposed at right angle to each other.

* * * * *